US010018410B2

(12) United States Patent
Dirnberger et al.

(10) Patent No.: US 10,018,410 B2
(45) Date of Patent: Jul. 10, 2018

(54) REFRIGERATION OR FREEZING CABINET WITH LIGHTING DEVICE ARRANGED ON CABINET DOOR

(71) Applicant: emz-Hanauer GmbH & Co. KGaA, Nabburg (DE)

(72) Inventors: Albert Dirnberger, Neunburg v.W. (DE); Manfredi Signorino, Nabburg (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 0 days.

(21) Appl. No.: 15/057,769

(22) Filed: Mar. 1, 2016

(65) Prior Publication Data

US 2016/0258672 A1 Sep. 8, 2016

(30) Foreign Application Priority Data

Mar. 6, 2015 (DE) ..... 10 2015 003 018

(51) Int. Cl.
*F25D 27/00* (2006.01)
*F25D 23/04* (2006.01)

(52) U.S. Cl.
CPC ..... *F25D 27/00* (2013.01); *F25D 23/04* (2013.01); *F25D 2323/021* (2013.01)

(58) Field of Classification Search
CPC ..... A47B 23/06; F21V 33/00; F25D 27/00; F27D 21/02
USPC ..... 362/133, 92, 94, 116, 127
See application file for complete search history.

(56) References Cited

U.S. PATENT DOCUMENTS 2,148,787 A 2/1939 Thomas
7,320,528 B2 1/2008 Gotz
8,021,009 B2 9/2011 Knoll et al.
(Continued)

FOREIGN PATENT DOCUMENTS

DE 10310330 A1 9/2004
DE 10336822 A1 3/2005
(Continued)

OTHER PUBLICATIONS

German Patent Office Search Report for priority document, DE 10 2015 003 018.3 dated Nov. 9, 2015.

*Primary Examiner* — Edwyn Labaze
(74) *Attorney, Agent, or Firm* — Robert R. Deleault, Esq.; Mesmer & Deleault, PLLC

(57) ABSTRACT

A refrigeration or freezing cabinet includes a cabinet corpus having an interior space configured for storing goods to be chilled or frozen, and a cabinet door which is attached to the cabinet corpus so as to be pivotable about a vertical axis of pivoting. In one embodiment, there is arranged or formed, on the inside of the door, a pair of rib members which extend vertically at a distance from one another and support one or more door shelving elements. In this embodiment, there is attached to one of the rib members of the pair, which rib member is located closer to the axis of pivoting, an illuminating strip designed with a plurality of lighting elements arranged vertically one above another. The illuminating strip is attached to that lateral face of the rib member in question which faces towards the interior space of the refrigerator when the door is open.

6 Claims, 2 Drawing Sheets

(56) References Cited

U.S. PATENT DOCUMENTS

| | | | | |
|---|---|---|---|---|
| 2003/0011291 | A1* | 1/2003 | Moreno-Olguin | F25D 23/04 312/405.1 |
| 2005/0011219 | A1* | 1/2005 | Asan | F25D 17/065 62/440 |
| 2009/0039749 | A1* | 2/2009 | Gerstner | F25D 23/04 312/404 |
| 2010/0066226 | A1* | 3/2010 | Luisi | F25D 23/126 312/405.1 |
| 2012/0286638 | A1* | 11/2012 | Lee | F25D 23/02 312/405 |
| 2012/0312798 | A1* | 12/2012 | Aoki | F25D 27/00 219/220 |
| 2014/0132128 | A1* | 5/2014 | Simon | A47F 3/0478 312/116 |
| 2014/0268648 | A1* | 9/2014 | Gomes | F25D 27/005 362/94 |
| 2016/0138782 | A1* | 5/2016 | Sckenkl | F21V 14/04 362/92 |
| 2016/0223250 | A1* | 8/2016 | Kang | F25D 29/00 |
| 2016/0327259 | A1* | 11/2016 | Pan | F21V 33/0044 |

FOREIGN PATENT DOCUMENTS

| | | | |
|---|---|---|---|
| DE | 10336833 | A1 | 3/2005 |
| DE | 102005057154 | A1 | 5/2007 |

* cited by examiner

REFRIGERATION OR FREEZING CABINET WITH LIGHTING DEVICE ARRANGED ON CABINET DOOR

BACKGROUND OF THE INVENTION

1. Field of the Invention

The present invention relates generally to a refrigeration or freezing cabinet having a corpus with an interior space which is configured for storing goods to be chilled or frozen, and also a door attached to the corpus so as to be pivotable about a vertical pivot axis.

2. Description of the Prior Art

In refrigerators or freezers of this kind it is often necessary, for reasons of user convenience, to illuminate the interior space in which the goods to be chilled or frozen are located, because the user is then better able to see where and what foods are located in the interior space. In conventional solutions, one or more lighting elements is/are often mounted, for this purpose, on the cabinet corpus in the region of one of the walls that delimit the interior space.

SUMMARY OF THE INVENTION

According to embodiments of the present invention, a lighting element for illuminating the interior space is attached to the door of the refrigeration or freezing cabinet. In these embodiments, there is provided, on the inside of the cabinet door, a wall structure which constitutes a wall surface that extends transversely, in particular substantially perpendicularly, to the plane of the door and faces towards the interior space when the door is in an open position. Arranged on this wall surface is at least one lighting element of a lighting device belonging to the refrigeration or freezing cabinet. Through the fact that a wall surface which faces towards the interior space when the door is in an open position is chosen for mounting the lighting element, it is possible to ensure that, whenever illumination of the interior space is desirable (namely when the door is open), the lighting element "looks", so to speak, into the interior space. When the door is closed, the orientation of the wall surface may, under certain circumstances, be unsuitable for bringing light from the lighting element into the interior space. As soon as the door is opened, however, the wall surface also pivots, together with the door, into a suitable orientation so that the interior space can be illuminated by the light of the lighting element.

When using a refrigeration or freezing cabinet, users often open the door by approximately 90° (for example within a range from about 80° to about 100°) when they want to place items in the refrigeration or freezing cabinet or take them out. Such a degree of opening of the door is typically sufficient to both obtain convenient access to the interior space and obtain access to door shelving provided on the inside of the door. Particularly in the case of refrigerators, door shelving of this kind is often provided which may consist of one or more door shelving elements which each constitute a storage compartment. The orientation of the wall surface relative to the plane of the cabinet door is, for example, such that, when the door is in an open position, which corresponds to opening by an angle within the range between about 80° and about 100° (referred to the closed position), optimum illumination of the interior space by the lighting device is made possible.

The wall structure may be arranged inside a door region which is bounded by a door seal.

The lighting device may include a plurality of lighting elements which are arranged vertically, one above another, on the wall surface at a distance from one another. In this way it is possible to achieve illumination of the interior space over at least a major part of its entire height.

In certain embodiments, the wall structure is constituted by a vertically extending rib member serving to support at least one door shelving element. The rib member may be one of a pair of vertically extending ribs (or strips), which serve as a lateral support system for one or more door shelving elements. The door shelving elements may be inserted between the ribs (or strips), which extend in a parallel manner, and the elements may be fixed to the ribs, for example by hooking-in. Since these ribs protrude transversely to the plane of the door, they each have a lateral face which faces towards the interior space when the door is in an open position. If an arrangement of one or more lighting elements is attached to the lateral face in question, on the one hand illumination of the interior space is possible when the door is open, and on the other hand it is possible to avoid unwanted weakening of those regions of the door which serve for thermal insulation.

In one embodiment, the rib member, which is equipped with at least one lighting element belonging to the lighting device, is arranged in the region of a side of the door shelving element that is located closer to the pivot axis. This precludes the possibility of the lighting element being concealed by foods which are placed in the door shelving element. What is also avoided in an optimum manner is a dazzling effect of the light from the lighting element, which effect a user may experience, under certain circumstances, on opening the door.

The wall structure may be an integral part of a door-skin element which lines the door on the inside. Alternatively it is conceivable for the wall structure to be constituted by a member which is constructed separately from a door-skin element of this kind and is mounted on the inside of the door.

The lighting element may comprise, for example, at least one light-emitting diode. For the purpose of producing white light, it is conceivable for each lighting element to comprise two or three light-emitting diodes which each radiate in different wavelength ranges and together produce the impression of white light for the user.

Embodiments of the present invention will be described in more detail hereinafter with reference to the accompanying drawings.

DETAILED DESCRIPTION OF THE PREFERRED EMBODIMENT

Figure 1:
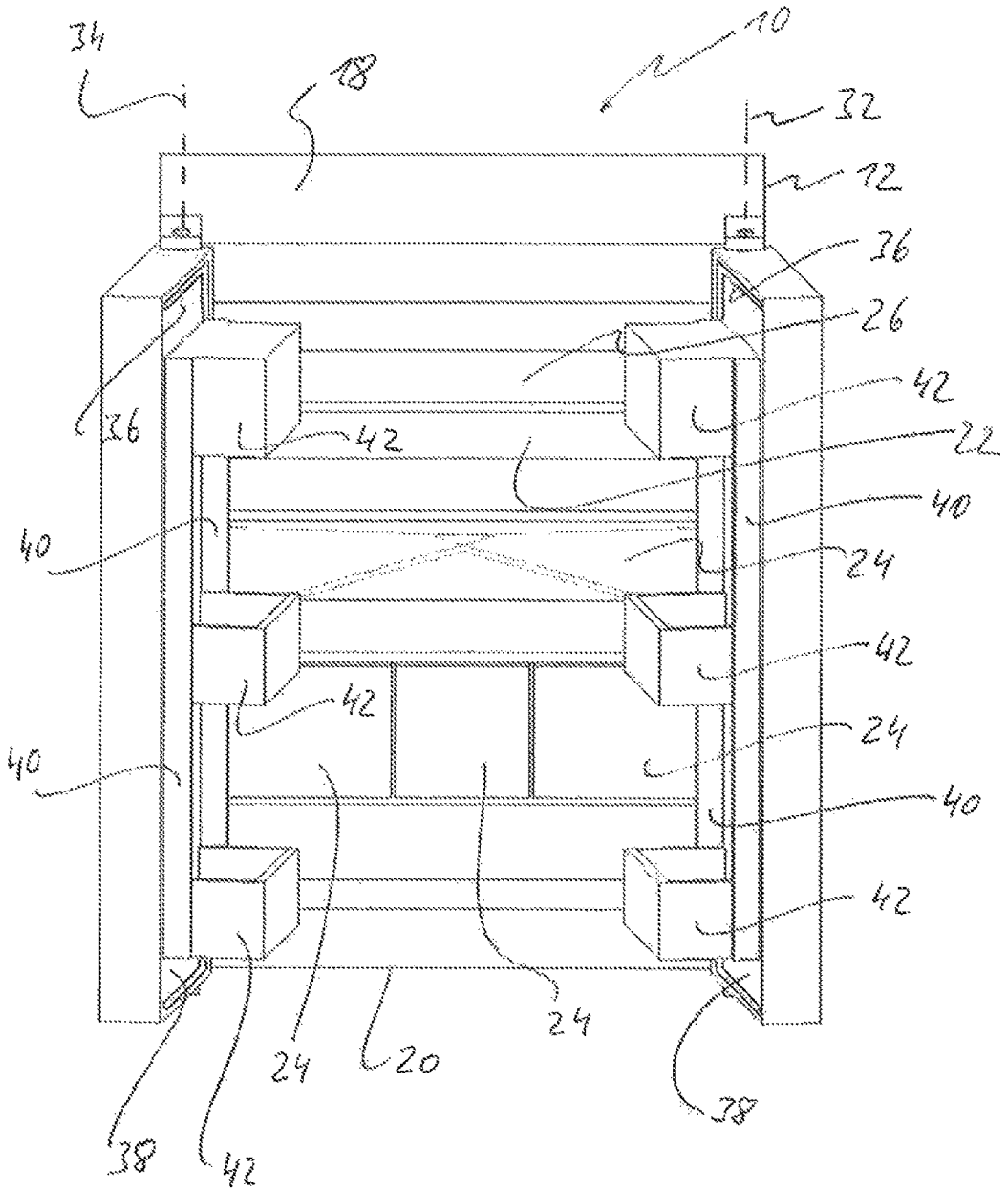
FIG. 1 represents a front view, slightly in perspective, of a refrigerator of the "side-by-side" design, with the door open.
Figure 2:
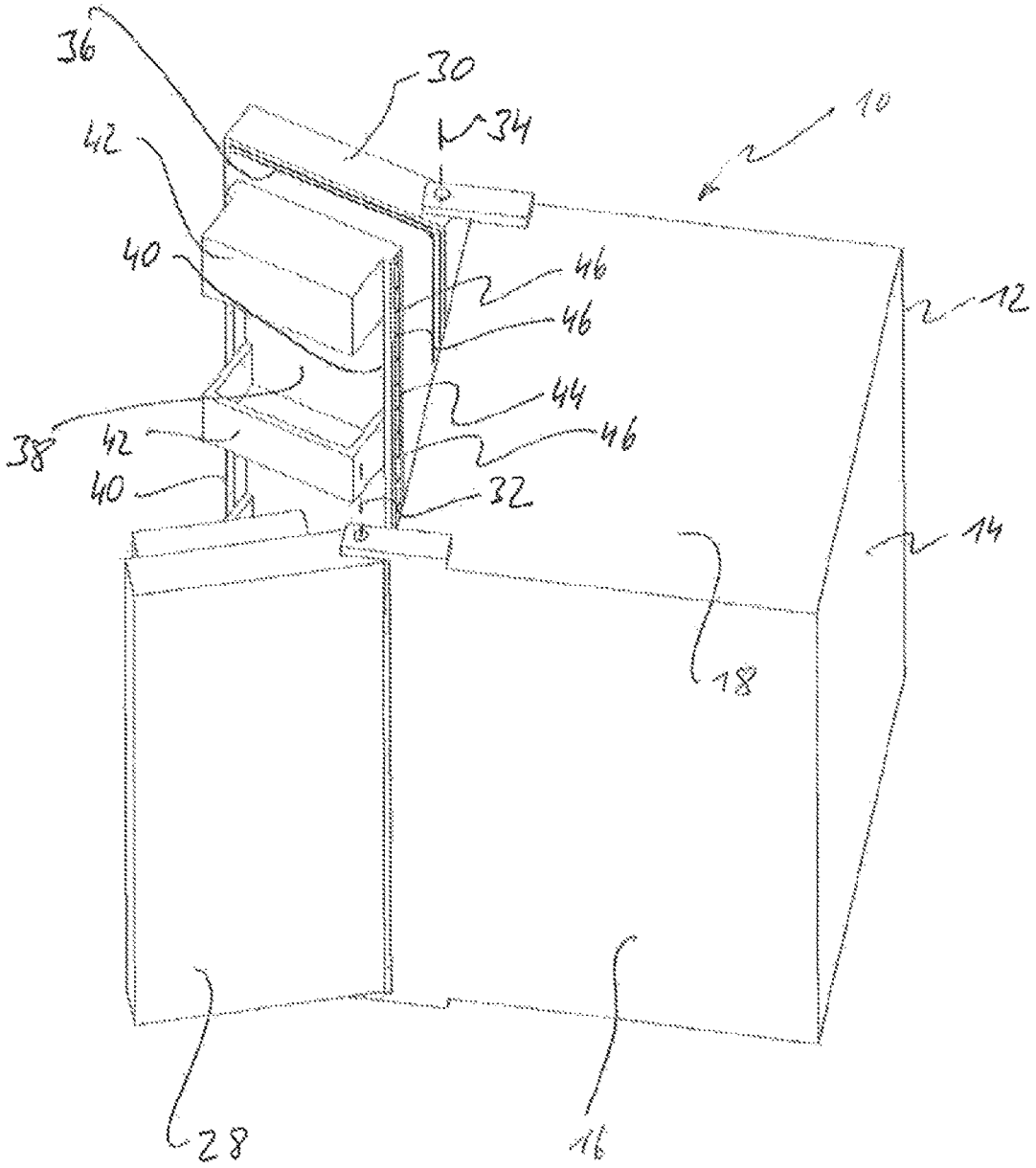
FIG. 2 represents the refrigerator in FIG. 1, viewed in perspective obliquely from above.

In the embodiment shown in FIGS. 1 and 2, the refrigerator is designated generally by 10. It has a cabinet corpus 12 with a rear wall 14, two mutually opposed sidewalls 16 (of which only one can be seen in FIG. 2), a capping wall 18 and a bottom wall 20. On the front side, the corpus 12 possesses an access aperture through which an interior space 22, which serves for storing goods to be chilled, is accessible. In the case of the example shown, the interior space 22 is equipped with a number of drawers 24 and a storage shelf 26. Naturally, the number of sliding compartments and depositing shelves with which the interior space 22 is equipped is not subject to limitations of any kind and may differ according to the particular application.

Two doors 28, 30 are attached to the corpus 12 so as to each be pivotable about a vertical axis of pivoting, 32 and 34 respectively. A sealing element 36 is located on the inside of the door 28 (i.e. on that side of the door which is directed towards the interior space 22 when the door is closed). A corresponding sealing element 36 is also located on the inside of the door 30. Together, the sealing elements 36 form a door seal which extends around the access aperture and which seals the interior space 22 towards the outside when the doors 28, 30 are closed.

On their inner sides, the two doors 28, 30 are each lined by means of a door-skin element 38 which is manufactured from plastic and behind which an insulating material, of which no further details are represented, is built into the respective door. In the case of at least one of the doors 28, 30 (on both doors in the case of the example shown), the door-skin element 38 in question is designed with two rib members (or strip members) 40 which extend vertically and are arranged next to one another at a distance and which serve to hold shelving elements 42. Each of the shelving elements 42 provides a storage compartment for bottles, cans or other goods for chilling which are to be stored. Together, the shelving elements 42 form a door shelving unit.

The rib members 40 constitute a one-piece part of the outer skin elements 38 and can be formed by suitable shaping when the outer skin elements 38 are manufactured. Alternatively, it is possible to provide strip elements which are separate from the outer skin elements 38 and to mount the strip elements on the inner sides of the doors 28, 30.

It can be seen that, in the case of the example shown, a pair of rib members 40, the distance between which approximately corresponds to the width of the shelving elements 42, is provided on each of the doors 28, 30. One of the rib members 40 belonging to each pair is arranged closer to the axis of pivoting of the door in question, and the other rib member is further away from the axis of pivoting. As FIG. 2 shows in the case of the door 30, there is attached to the rib member 40 located closer to the axis of pivoting 34 an illuminating strip 44 which extends over a large part, or even over substantially the entire length, of the rib member 40 in question and is attached to that lateral face (or lateral cheek) of the rib member 40 which is directed towards the interior space 22 of the refrigerator 10 when the door 30 is open. In the case of the example shown, the illuminating strip 44 contains a large number of lighting elements 46 which are arranged vertically, one above another, at a distance from one another and which are each manufactured, for example, by LED technology. The lighting elements 46 may, for example, be deposited on a carrier element formed from a strip material, in which case the strip-like carrier element may, in turn, be bonded to the rib member 40 in question belonging to the door 30.

Although not represented in the drawings, a corresponding illuminating strip 44 may also be provided on the door 28, on that rib member 40 on the latter which is located closer to the axis of pivoting 32.

Since the rib members 40 protrude transversely to the plane of the respective door, so that their lateral cheeks stand approximately perpendicular to the respective plane of the door, the consequence of this is that, when the door 30 is in the open position shown in the two FIGS. 1 and 2, the light produced by the illuminating strip 44 passes, in the optimum manner, into the interior space 22 and illuminates it. A user standing in front of the refrigerator will not be dazzled by this light. It is likewise not possible to impair the lighting effect of the illuminating strip 44 by items placed immediately in front of it, because there is no possibility of depositing them immediately in front of the illuminating strip 44.

The rib members 40 which are each provided with an illuminating strip 44 each constitute a wall structure within the meaning of the invention. As can easily be seen in FIG. 2, they are arranged inside that door region which is bounded by the door seal mentioned (which is formed by the two sealing elements 36 on the doors 28, 30).

The illuminating strips 44 may be fed electrically (in a manner of which no further details are represented in the drawings) from one end of the strip. In modern refrigerators, components which require an electric current supply (e.g. an ice-dispenser, an illuminated cool-box which is accessible from the outside or a digital display) are often already present in the door, so that electric supply leads from the corpus 12 to the doors 28, 30 are, in certain circumstances, already present in practice.

If the lighting device in the door, which device has the lighting elements 46, is sufficiently bright, it is possible to dispense with attaching additional lighting elements in the region of the interior space 22 of the refrigerator. This is favourable because it is possible, by attaching lighting elements in the region of the interior space 22, to avoid weakening interior-space insulation which is arranged behind an interior-space lining which delimits the interior space.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A refrigeration or freezing cabinet comprising:

a corpus having an interior space configured for storing goods to be refrigerated or frozen;

a door attached to the corpus so as to be pivotable about a vertical pivot axis, wherein a vertical extending rib member configured to support at least one door shelving element is provided on the inside of the door, the rib member having a lateral face which extends transversely to the plane of the door and faces towards the interior space when the door is in an open position; and a lighting device including at least one lighting element arranged on the lateral face of the rib member wherein the at least one lighting element passes light into the interior space to illuminate the interior space when the door is in the open position.

2. The refrigeration or freezing cabinet of claim 1 wherein the rib member is arranged inside a door region bounded by a door seal.

3. The refrigeration or freezing cabinet of claim 1 wherein the lighting device includes a plurality of lighting elements arranged vertically one above another on the lateral face of the rib member at a distance from one another.

4. The refrigeration or freezing cabinet of claim 1 wherein the rib member is arranged in the region of a side of the door shelving element which is closer to the pivot axis.

5. The refrigeration or freezing cabinet of claim 1 wherein the rib member is an integral part of a door-skin element lining the door on the inside.

6. The refrigeration or freezing cabinet of claim 1 wherein the lighting element comprises at least one light-emitting diode.

* * * * *